United States Patent [19]

Tharman

[11] Patent Number: 4,971,001

[45] Date of Patent: Nov. 20, 1990

[54] ENGINE SHUT-OFF SYSTEM

[75] Inventor: Paul A. Tharman, Milwaukee, Wis.

[73] Assignee: Briggs & Stratton Corporation, Wauwatosa, Wis.

[21] Appl. No.: 424,080

[22] Filed: Oct. 19, 1989

[51] Int. Cl.[5] ..... F02B 77/00

[52] U.S. Cl. ..... 123/198 DC; 123/198 D

[58] Field of Search ..... 123/198 DC, 198 D

[56] References Cited

U.S. PATENT DOCUMENTS

| | | | |
|---|---|---|---|
| 3,356,082 | 12/1967 | Jukes | 123/335 |
| 3,484,677 | 12/1969 | Piteo | 322/91 |
| 3,521,612 | 7/1970 | Santi et al. | 123/179 |
| 3,581,720 | 6/1971 | Hemphill et al. | 123/179 |
| 3,601,103 | 8/1971 | Swiden | 123/198 D |
| 3,726,265 | 4/1973 | Howard | 123/198 DC |
| 3,731,471 | 5/1973 | Bening | 56/10.5 |
| 3,733,794 | 5/1973 | Allen | 56/10.5 |
| 3,782,084 | 1/1974 | Harkness | 56/10.5 |
| 4,003,190 | 1/1977 | Braun et al. | 56/10.5 |
| 4,033,311 | 7/1977 | Burson | 123/198 D |
| 4,034,732 | 7/1977 | Van Burkleo | 123/198 DC |
| 4,054,117 | 10/1977 | Palmer et al. | 123/198 D |
| 4,120,277 | 10/1978 | Ehlen | 123/149 D |
| 4,147,151 | 4/1979 | Wright | 123/198 DC |
| 4,181,206 | 1/1980 | Seilenbinder | 192/0.084 |
| 4,294,327 | 10/1981 | Howard | 123/198 DC |
| 4,369,745 | 1/1983 | Howard | 123/198 DC |
| 4,459,951 | 7/1984 | Tobinaga et al. | 123/198 DC |
| 4,522,170 | 6/1985 | Lenk et al. | 123/198 DC |
| 4,531,500 | 7/1985 | Burson | 123/198 D |
| 4,565,179 | 1/1986 | Nytomt et al. | 123/198 DC |
| 4,622,935 | 11/1986 | Janisch | 123/198 DC |
| 4,684,917 | 8/1987 | Tharman | 123/198 D |
| 4,754,732 | 7/1988 | Kuczenski et al. | 123/198 DC |

*Primary Examiner*—Noah P. Kamen

*Attorney, Agent, or Firm*—Andrus, Sceales, Starke & Sawall

[57] ABSTRACT

An improved engine shut-off system is provided in which the likelihood of a safe failure is maximized and the likehood of an unsafe failure is minimized. Both terminals of the engine's first safety stop switch are connected in the ignition circuit so that if either wire leading to a stop switch terminal is grounded or breaks, a fail-safe condition exists. A first terminal of the first stop switch is connected in circuit to the main coil's primary winding, and the second terminal is connected in circuit to either the control switch means or the trigger coil. An optional second stop switch may be used in conjection with the first stop switch. The optional second stop switch may be a seat switch.

3 Claims, 3 Drawing Sheets

ENGINE SHUT-OFF SYSTEM

BACKGROUND OF THE INVENTION

This invention relates to ignition systems for internal combustion engines, and more particularly to apparatus for safely shutting off an internal combustion engine.

Conventional ignition apparatus for internal combustion engines comprises a primary and a secondary winding that are inductively coupled with one another, a spark plug connected across the terminals of the secondary winding, and control switch means for closing a circuit to enable current to flow in the primary winding and for opening that circuit at a time in the engine cycle when the spark plug is to be fired. In a battery ignition system, the closing of the circuit which includes the control switch means allows battery current to flow in the primary winding. In a magneto ignition system, an electromagnetic field is induced in the primary winding by an orbitally moving magnet in cooperation with a fixed ferromagnetic core around which the primary and secondary windings are wound. Closing of the control switch means short-circuits the primary to allow current to flow in it. In either case, opening the primary circuit brings about an abrupt change in a flux field with the secondary winding, thereby inducing a high voltage across the secondary. The conventional control switch means typically has included a pair of hard metal breaker points that were actuated by a mechanism having a cam which rotated in timed relation to the engine cycle. More recently, the control switch means includes a semiconductor device such as a transistor, and a simple means for turning on and turning off the semiconductor device in timed relation to the engine cycle.

Several techniques are known for stopping an internal combustion engine using a safety switch. One such prior art technique is disclosed in U.S. Pat. No. 4,270,509 issued June 2, 1981 to Tharman, and assigned to Briggs & Stratton Corporation, the assignee of the present invention. As depicted in FIG. 6 of U.S. Pat. No. 4,270,509, a safety switch has one terminal connected to the control switch means, with the other safety switch terminal being grounded. When the safety switch is closed the primary winding is grounded, thereby shutting off the engine. An advantage of this so-called ground-to-stop technique is that if the wire connecting the primary winding to the stop switch shorts out to, for example, a metal part on the vehicle, the engine still shuts off. A disadvantage of this technique is that if the wire connecting the primary winding and the stop switch opens or breaks, the stop switch is effectively taken out of the ignition circuit, and cannot be used to stop the engine.

Another prior art technique that uses a single wire connected from the ignition circuit to the stop switch has a stop switch which is opened to shutoff the engine. This so-called open-to-stop technique has one terminal of the stop switch connected in circuit to the control switch means, with the other terminal being grounded. An advantage of this second prior art technique is that if the wire connecting the circuit with the stop switch is opened or breaks, the engine is shut off and a safe failure occurs. However, a disadvantage of this second technique is that if the single wire connecting the circuit to the stop switch is shorted to ground for any reason, the operator will not be able to stop the engine with the stop switch. Another disadvantage of this second technique is that the resistance in the primary circuit is increased, causing possible loss in voltage in the primary circuit.

In summary, both of these prior art techniques have a significant chance of failing in an unsafe mode, preventing the stop switch from shutting off the engine.

SUMMARY OF THE INVENTION

An improved engine shut-off system is provided in which the likelihood of a safe failure is maximized, and the likelihood of an unsafe failure is minimized. The shut-off system is used with an engine ignition system having a main core that supports a primary winding and a secondary winding, and having a control switch means connected in circuit with the primary winding that is operable in response to a control signal. The control switch means controls the flow of current in the primary winding. The ignition system also includes a trigger coil connected to generate a control signal to the control switch means.

In one embodiment, the improvement comprises a first safety stop switch whose first terminal is connected in circuit with the primary winding, and whose second terminal is connected in circuit with the control switch means. Since both terminals are connected to the ignition circuit, shorting or breaking of either wire leading to the first stop switch terminals results in a fail-safe condition and the engine being shut off. An unsafe failure occurs only in the unlikely event that both wires leading to the two first stop switch terminals are shorted together. In a preferred embodiment, the first stop switch stops the engine when the switch is in an open position.

An optional second stop switch may be used in conjunction with the first stop switch. The second stop switch has a terminal, sometimes designated herein as the third terminal, that is connected in circuit with the primary winding, and another terminal, sometimes designated herein as the fourth terminal, that is connected in circuit with the control switch means. In riding lawn mowers, tractors or the like, the second stop switch may be a seat switch which shuts off the engine unless a sufficient weight is placed on the vehicle's seat.

In another embodiment, the improvement according to the present invention comprises a first stop switch whose first terminal is connected in circuit with the primary winding, and whose second terminal is connected in circuit with the trigger coil instead of being connected to the control switch means as in the first embodiment discussed above. This second embodiment has similar advantages to the first embodiment in that an unsafe failure occurs only in the unlikely event that both wires leading to the first and second terminals of the first stop switch are shorted together. If either wire is shorted to ground, opens or breaks, a safe failure occurs since the engine shuts off.

The latter embodiment of the present invention may also include a second stop switch having a terminal, sometimes designated herein as the third terminal, connected in circuit with the primary winding, and another terminal, sometimes designated herein as the fourth terminal, connected in circuit with the trigger coil. If the improved ignition system is used in a riding vehicle, a second stop switch may be a seat switch that shuts off the engine if a predetermined weight is not present on the vehicle's seat. The first stop switch preferably stops the engine when the switch is in an open position.

It is a feature and advantage of the present invention to increase the safety of vehicles powered by internal combustion engines.

It is another feature and advantage of the present invention to provide an engine shut-off system in which the likelihood of a safe failure is maximized, and the likelihood of an unsafe failure is minimized.

These and other features and advantages of the present invention will be apparent to those skilled in the art from the following detailed description and attached drawings, in which:

DETAILED DESCRIPTION OF PREFERRED EMBODIMENTS

Figure 1:
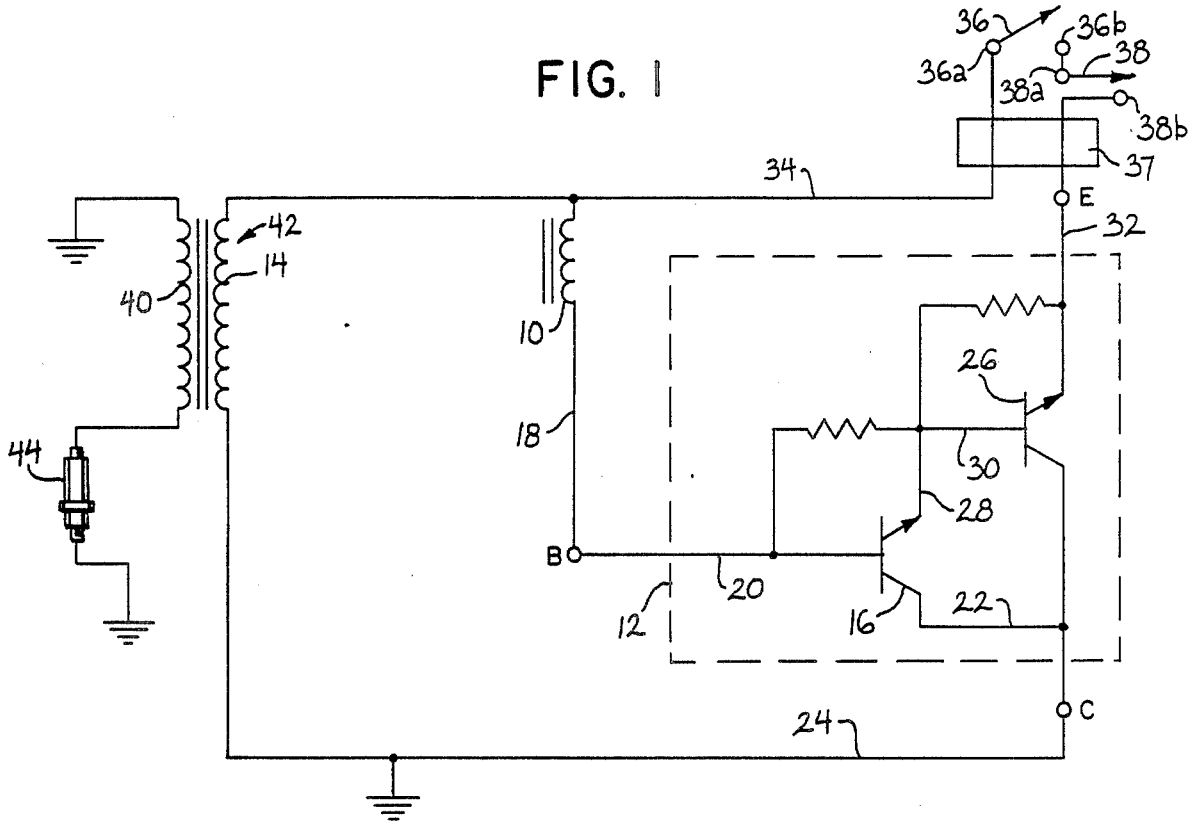
FIG. 1 is a schematic drawing of a first embodiment of the present invention.

Although the present invention may be used with both battery ignition systems and magneto ignition systems, the invention is described herein in connection with a magneto ignition system of the type used in small engines for powering lawn mowers, pumps and electrical generators. However, the scope of the present invention extends to battery ignition systems as well.

The embodiments described herein which incorporate the present invention assume that a single-cylinder engine is used having a single spark plug. However, the present invention is not limited to use with such engines, and may be adapted to multi-cylinder engines.

The embodiments depicted in the drawings and described below are breakerless ignition systems wherein conventional mechanically actuated breaker points have been replaced by electronic control switch means such as a Darlington device. However, the present invention is not limited to use with breakerless ignition systems, and may be used with ignition systems having conventional breaker points.

The general operation of the breakerless ignition system will be described in connection with FIG. 1. Referring to FIG. 1, a rotating magnet assembly (not shown) cooperates with trigger coil 10 and its core (not shown) to turn on control switch means 12 at the time in the engine cycle when conventional breaker points would close, and to turn off control switch means 12 abruptly at the time when breaker points would open to produce a spark. Trigger coil 10, which is connected to control switch means 12 at base B of control switch means 12, operates control switch means 12 to close and open the circuit between the terminals of primary winding 14 in properly timed relation to the engine cycle. The terminals of primary winding 14 are connected to the emitter E and the collector C of control switch means 12.

Figure 2:
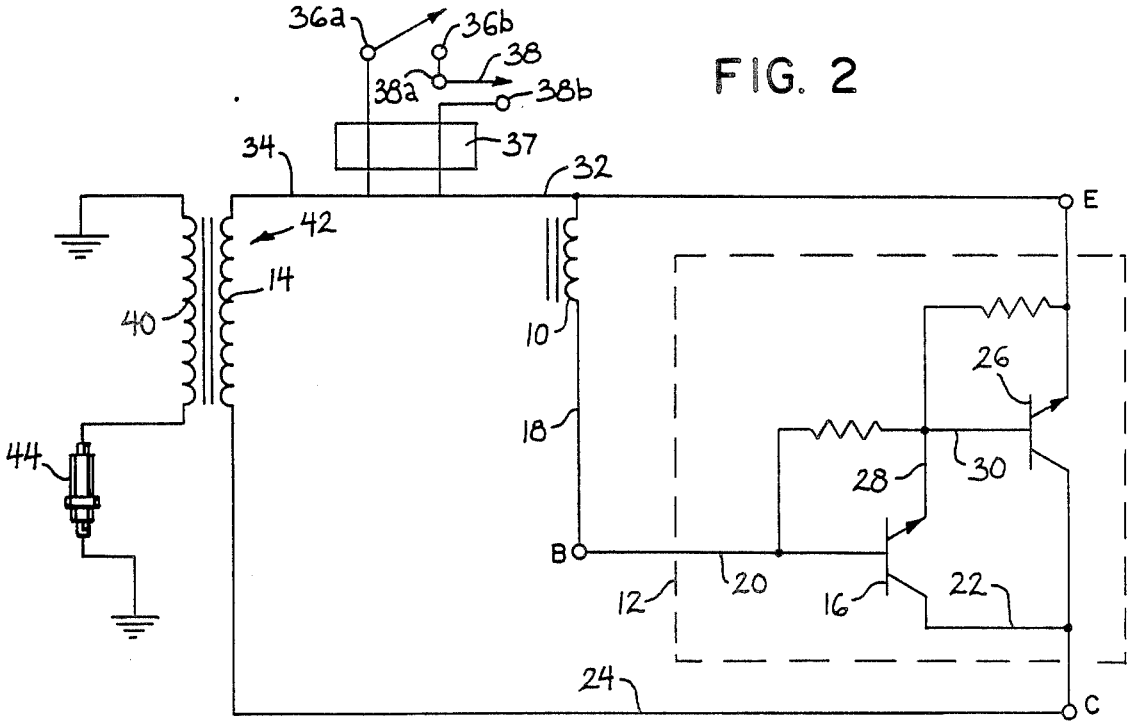
FIG. 2 is a schematic drawing of a second embodiment of the present invention.
Figure 3:
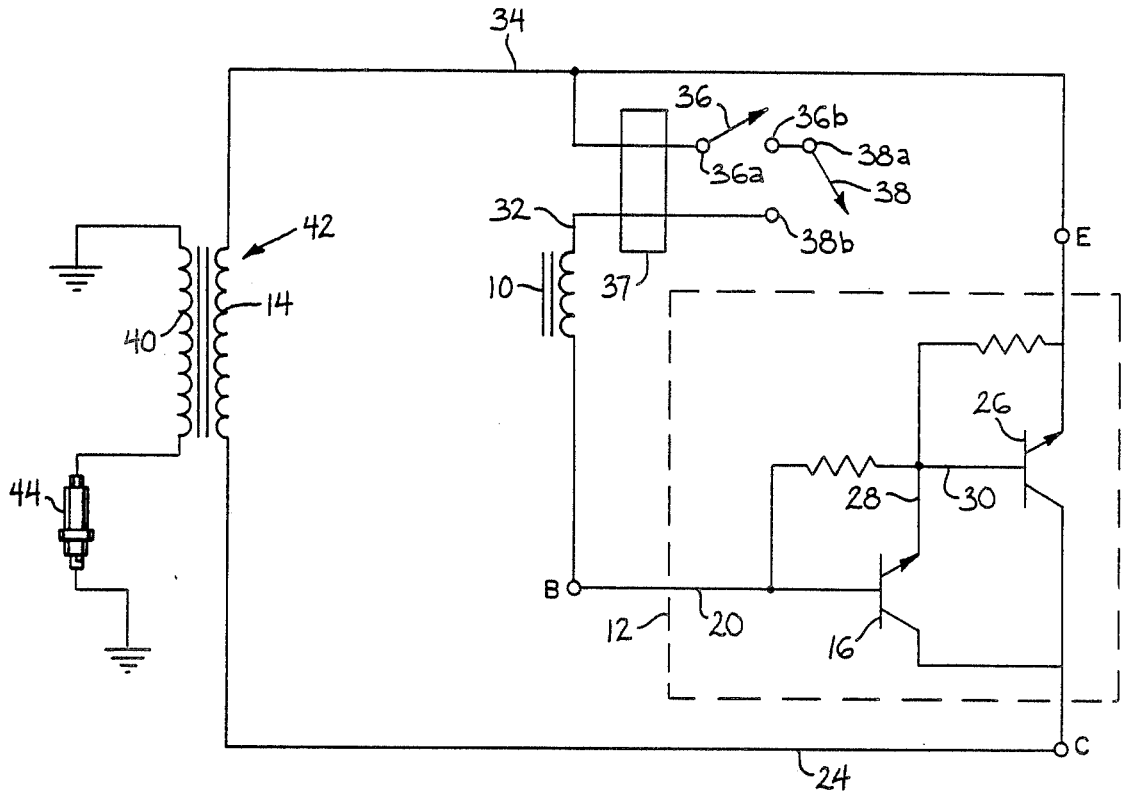
FIG. 3 is a schematic drawing of a third embodiment of the present invention.

Control switch means 12 is depicted in FIGS. 1–3 as a monolithic Darlington device. The Darlington switch device is preferred because of its high gain, but it could be replaced with a unitary gain transistor.

If a Darlington device is used for control switch means 12, then trigger coil 10 is connected to the base of transistor 16 via lines 18 and 20. The collector of transistor 16 is connected to one terminal of primary winding 14 and to ground via lines 22 and 24. The emitter of transistor 16 is connected to the base of transistor 26 via lines 28 and 30. The emitter of transistor 26 is in turn connected to the other terminal of primary winding 14 via lines 32 and 34, and via stop switches 36 and 38. Assuming that first stop switch 36 and second stop switch 38 are closed, the turning on or closing of control switch means 12 enables the current to flow in primary winding 14. Current flow in primary winding 14 induces a high voltage across secondary winding 40 of the main core 42, firing spark plug 44.

The improvement according to the present invention comprises a first stop switch 36 whose first terminal 36*a* is connected via line or wire 34 in circuit with primary winding 14, and whose second terminal 36*b* is connected in circuit via line 32 with control switch means 12. The opening of first stop switch 36 opens the circuit by disconnecting lines 34 and 32, thereby shutting off the engine. If either line 34 or line 32 is open or shorted to ground so that switch 36 becomes inoperative, the ignition system will still fail in a safe mode and the engine will be shut off. The only way that the ignition system will fail in an unsafe mode is if lines 34 and 32 are shorted to each other, thereby bypassing switch 36 altogether. Such an unsafe failure would occur in the unlikely event that the insulation of both wires 34 and 32 would be rubbed off and the two uninsulated portions would meet to short the wires to each other.

The ignition circuit depicted in FIG. 1 also includes an optional second stop switch 38 having a terminal 38*a*, sometimes designated herein as the third terminal, connected in circuit with primary winding 14 via first stop switch 36 and line 34. The other terminal 38*b* of second stop switch 38, sometimes designated herein as the fourth terminal, is connected in circuit with control switch means 12 via line 32. In riding vehicles such as tractors or riding lawn mowers, second stop switch 38 may be a seat switch that opens if a sufficient weight is not present on the vehicle's seat.

The ends of the two wires 32 and 34 which are nearest first stop switch 36 are taken out of the engine compartment and retained in place by connector 37, which in turn is typically fixed to the engine body.

FIG. 2 depicts another embodiment of the present invention. In FIGS. 1, 2 and 3, corresponding components having similar functions have been given the same numerical designations. The above description of the general operation of the ignition system in FIG. 1 is applicable to FIGS. 2 and 3 and need not be repeated. The primary differences between the embodiments depicted in FIGS. 1, 2 and 3 are the placements of first stop switch 36 and optional second stop switch 38 in the ignition circuits.

Referring now to FIG. 2, first stop switch 36 has a first terminal 36*a* connected in circuit with primary winding 14 via line 34. The second terminal 36*b* of switch 36 is connected in circuit with both trigger coil 10 and the emitter E of control switch means 12 via line 32 and switch 38. Optional second stop switch 38, in series with switch 36, has a third terminal 38*a* connected in circuit with primary winding 14 via line 34 and switch 36. The fourth terminal, designated 38*b*, of second stop switch 38 is connected in circuit with both trigger coil 10 and emitter E of control switch means 12 via line 32.

As in FIGS. 1 and 3, both switches 36 and 38 must be closed for the engine to run. Of course, the safety switch arrangement including switches 36 and 38 could be changed so that one or both of switches 36 and 38 could be closed to shut off the engine. The latter arrangement would still be within the spirit and scope of the present invention.

As in the embodiments depicted in FIGS. 1 and 3, the embodiment depicted in FIG. 2 will fail in a safe mode and shut-off the engine if either or both of lines 34 or 32 is shorted to ground, and if either or both of lines 34 and 32 is open or breaks. The only way that the safety switch arrangement will fail in an unsafe mode is if the unlikely event occurs that lines 34 and 32 are shorted to each other.

FIG. 3 depicts another embodiment of the ignition system according to the present invention. The embodiment depicted in FIG. 3 has the advantage over the embodiments depicted in FIGS. 1 and 2 in that resistance in the primary circuit is not increased, thereby avoiding any voltage loss in the primary circuit.

Referring now to FIG. 3, first stop switch 36 has its first terminal **36*a* connected in circuit with primary winding 14 via line 34. The second terminal 36*b* of switch 36 is connected in circuit with trigger coil 10 via second stop switch 38 and line 32. Second terminal 36*b* is also connected in circuit with the base B of control switch means 12 via second stop switch 38, line 32, trigger coil 10 and line 20**.

Optional second stop switch 38 has a third terminal **38*a* connected in circuit with primary winding 14 via first stop switch 36 and line 34. The other terminal of second stop switch 38, designated the fourth terminal or 38*b*, is connected in circuit with trigger coil 10 via line 32. Terminal 38*b* is also connected in circuit with the base B of control switch means 12 via lines 32, trigger coil 10, and line 20**.

As in FIGS. 1 and 2, the safety switch arrangement depicted in FIG. 3 requires that both first stop switch 36 and second stop switch 38 be closed for the engine to run. Again as in the embodiments depicted in FIGS. 1 and 2, the shorting of either or both of lines 34 and 32 to ground will result in a safe failure since the engine will stop running. The opening or breaking of either of lines 34 or 32 will similarly result in a safe failure. The only unsafe failure will occur in the unlikely event that lines 34 and 32 are shorted to each other.

Although several embodiments of the present invention have been shown and described, various other embodiments and modifications will be apparent to those skilled in the art and are within the scope of the present invention. Therefore, the scope of the present invention is to be limited only by the following claims.

I claim:

1. In an engine ignition system having a main core which supports a primary winding and a secondary winding, a control switch means connected in circuit with the primary winding and being operable in response to a control signal for controlling the flow of current in said primary winding, and a trigger coil connected to generate a control signal to said control switch means, the improvement comprising:

a first stop switch that stops said engine when said switch is in an open position, said switch having a first terminal and a second terminal, the first terminal being connected in circuit with said primary winding, and the second terminal being connected in circuit with the control switch means.

2. In an engine ignition system having a main core which supports a primary winding and a secondary winding, a control switch means connected in circuit with the primary winding and being operable in response to a control signal to control the flow of current in said primary winding, and a trigger coil connected to generate a control signal to said control switch means, the improvement comprising:

a first stop switch that stops said engine when said switch is in an open position, said switch having a first terminal and a second terminal, the first terminal being connected in circuit with said primary winding, and the second terminal being connected in circuit with the trigger coil.

3. In an engine ignition system having a main core which supports a primary winding and a secondary winding, a control switch means connected in circuit with the primary winding and being operable in response to a control signal for controlling the flow of current in said primary winding, and a trigger coil connected to generate a control signal to said control switch means, the improvement comprising:

a first stop switch that stops said engine when said switch is in an open position, said switch having a first terminal and a second terminal, the first terminal being connected in circuit with said control switch means, and the second terminal being connected in circuit with said trigger coil.

* * * * *